United States Patent [19]

Fitz

[11] Patent Number: 4,962,974

[45] Date of Patent: Oct. 16, 1990

[54] SLIDE FOR DRAWERS

[75] Inventor: Alexander Fitz, Schaan, Liechtenstein

[73] Assignee: Anstalt Agenda, Vaduz, Liechtenstein

[21] Appl. No.: 326,372

[22] Filed: Mar. 20, 1989

[30] Foreign Application Priority Data

Mar. 23, 1988 [CH] Switzerland ..... 1093/88

[51] Int. Cl.[5] ..... A47B 88/00

[52] U.S. Cl. ..... 312/333; 312/341.1; 312/348

[58] Field of Search ..... 312/341.1, 348, 333

[56] References Cited

U.S. PATENT DOCUMENTS 2,728,626 12/1955 Gussack ..... 312/348 X
3,328,106 6/1967 Mullin ..... 312/341.1
3,701,577 10/1972 Fischer ..... 312/348 X
3,746,418 7/1953 Barber ..... 312/348
3,860,308 1/1975 Burke ..... 312/348 X
4,560,212 12/1985 Papp et al. ..... 312/348 X

*Primary Examiner*—Joseph Falk

[57] ABSTRACT

In a slide for drawers, compartment bases and the like, having guides on the carcass and the drawer or compartment base which are preferably formed from tracks (1, 2) and having running surfaces (5, 6, 13) for rollers (7, 11) mounted on the other guide, the carcass guides (1) having upper and lower running surfaces (5, 6) leaving insertion apertures (12) in the front end region for the rollers (7) mounted on the drawer guide (2), lockable securing means against withdrawal, preferably displaceable catches (15), are provided on the carcass guides (1) behind the inserted rollers (7) of the drawer guides (2), the said securing means, in their blocking position, preventing the emergence of the inserted rollers (7).

9 Claims, 2 Drawing Sheets

3
8
1
5
3a
12
15
9
19
13
7
2
14
4
6
17
11
16
18
21
10

3
1
8
5
3a
13
15
9
11
19
10
III
18
21
16
17
14
2
7
6
4

3
8
13
1
2
11
18
21
14

SLIDE FOR DRAWERS

BACKGROUND OF THE INVENTION

1. Field of the Invention

The invention relates to a slide for drawers, compartment bases and other components which can be fixed to a carcass or frame with slides in such a way that they can be pulled out, preferably having guides, formed from tracks, on the carcass and drawer or compartment base, which have running surfaces for rollers mounted on the other guide, the carcass guides having upper and lower running surfaces leaving insertion apertures, in the front end region, for the rollers mounted on the drawer guide.

2. Description of the Related Art

With the aid of such slides, the displaceable parts can be displaced against frictional resistance which is small owing to the rollers. Preferred embodiments are those in which the guides consist of tracks which can be fixed to the carcass or to the drawer or to the compartment base, and the carcass rail can have a C-shaped cross-section, so that the insides of the flanges form the running surface with the roller or rollers of the drawer or compartment base track, the said roller or rollers generally being in the rear end region of this drawer track. The drawer track may form an outward-projecting flange whose lower side forms a running surface which rests on a front roller of the carcass track. It is also possible, particularly where plastic moldings are used, to provide the carcass guides in the form of an indented part in a lateral wall part of the carcass, and to form the drawer guide on a lateral frame wall of the drawer. It is necessary to restrict the withdrawal of the drawer, compartment base, etc. in order to prevent the rollers of the drawer or the like from coming out of the carcass guides and the drawer therefore falling out or tilting.

NL-A-7101173 describes, for example, a securing means which is fixed to the carcass track of the drawer guide, and requires recesses in this track and must be inserted in the correct position. It can be used for other forms of track only where it is possible to provide the necessary recesses.

Furthermore, this securing part does not have complete operational reliability since it can be pushed, together with the drawer, to such an extent that the stop projection of the securing means against withdrawal can escape through the lower slot in the carcass track. It is also expensive to provide and requires more operations during assembly.

SUMMARY OF THE INVENTION

It is the object of the invention to provide a slide in which simple and easily operated means for limiting withdrawal are provided.

According to the invention, interlockable securing means against withdrawal, preferably adjustable locks are provided on the carcass guides, behind the inserted rollers of the drawer guides, the said securing means, in their blocking position, preventing the inserted rollers from coming out of the carcass guides and hence tipping of the drawer or like or emergence of its rollers from the drawer guides.

Different design variants are possible. The securing means against withdrawal consists, for example of, a loose plastic part which can very easily be clipped on behind the roller or the carcass track after a drawer has been inserted.

As a result of closing the drawer, this securing means against withdrawal is automatically positioned to prevent unintentional withdrawal of the drawer. It can be used for various types of drawer guides and does not constitute part of the slide system. In a preferred embodiment, with a conventional form of the carcass guide having a roller mounted in the front end region and with formation of the insertion aperture of the upper running surface which begins at least a distance corresponding to the roller diameter away from the roller, swivel catches which are mounted on the axles of the front carcass rollers or are pushed onto these axles serve as securing means against withdrawal, the said swivel catches being displaceable from a rest position adjacent to the lower running surface of the carcass guide into a blocking position projecting into the pull-out path of the drawer roller. These securing means against withdrawal can remain on the carcass guide and, in their rest position, permit the drawer roller to be inserted into the carcass guide. After this insertion procedure, the swivel catches are displaced into the blocking position and then serve as securing means against withdrawal. If it is desired to remove the drawer or the like, the swivel catches can be brought to the rest position again for this purpose. At least in the blocking position, the swivel catches are preferably fixable by frictional interlocking or by spring-loaded locking projections engaging appropriate recesses in the carcass guides, in order to ensure that the swivel catches must be deliberately swivelled in the inactive rest position only when it is intended to remove the drawer or the like.

To increase the operational safety further and to facilitate operation, it is envisaged that the swivel catches carry actuating extensions which, in the rest position, project outward from the carcass guide and form stops for a front panel, or the like, of the drawer or of the compartment base, so that, by closing the drawer or completely inserting the compartment base, the catches can be displaced into the blocking position by means of these stops and can be displaced into the rest position via the end parts which are readily accessible from the front end of the carcass guides, even when the drawer is slightly pulled out, if it is intended to remove the drawer or the like.

BRIEF DESCRIPTION OF THE DRAWINGS

Further details and advantageous embodiments of the subject of the invention are given in the following description of the drawing.

The drawing shows examples of the subject of the invention.

DESCRIPTION OF PREFERRED EMBODIMENTS

Figure 1:
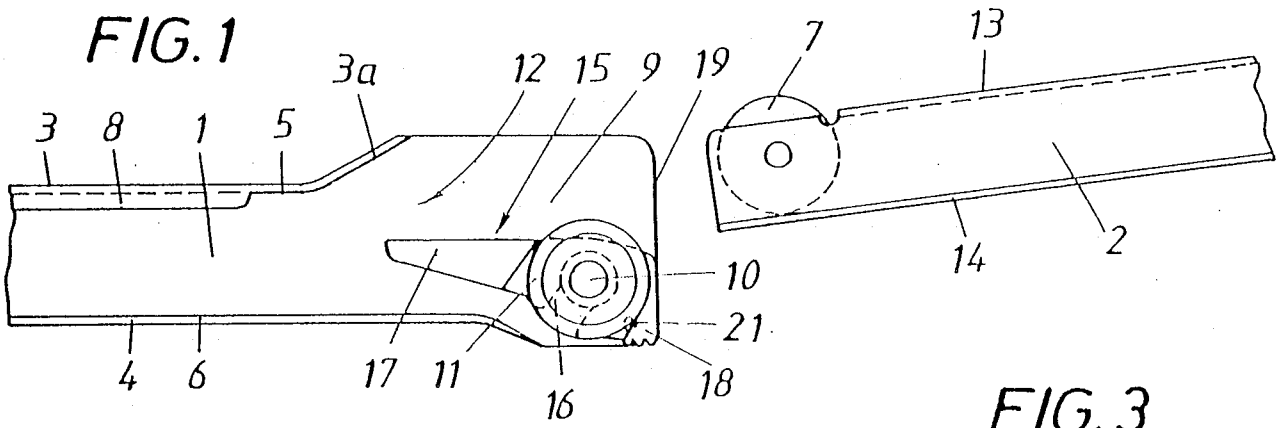
FIG. 1 shows a slide consisting of a carcass track and a drawer track, for one side of a drawer, the drawer and the carcass being omitted, in the pull-out state.

The guide tracks 1, 2, i.e. a carcass track 1 and a drawer track 2, are provided for each of the two sides of a drawer or of a compartment base. The carcass track 1 has a C-shaped cross-section for the major part of its length, the insides of the flanges 3, 4 forming running surfaces 5, 6 for a roller 7 mounted, so that it projects laterally, at the rear end of the drawer track 2. The edge 8 of the upper flange 3 is bent downward for additionally securing the roller 7.

Figure 2:
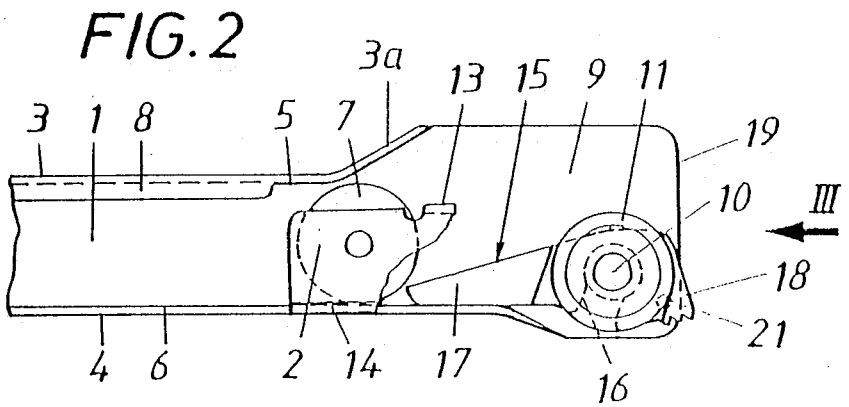
FIG. 2 shows a representation corresponding to FIG. 1, directly after insertion of the roller of the drawer track into the carcass track.
Figure 3:
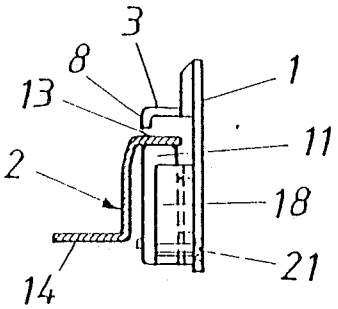
FIG. 3 shows a side view of FIG. 2 in the direction of arrow III in FIG. 2, the drawer track being shown in cross-section.
Figure 5:
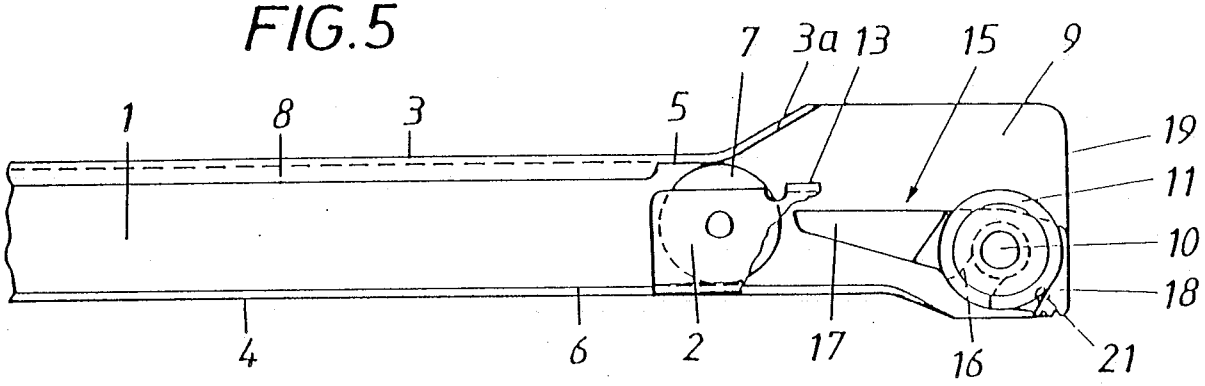
FIG. 5 shows a representation corresponding to FIG. 2, with swivel catches in the blocking position and showing an alternate embodiment in which the swivel catches are spring loaded.

At the front end of the carcass track 1, the flanges 3, 4 become a support plate 9, the flange 4 extending almost to a roller 11 mounted in the front end region of the support plate on an axle 10, and the flange 3 being increased in height to form plate 9 and ending before flange 4, so that, between its higher part and the roller 11, an insertion aperture 12 is formed, by means of which the roller 7 can be made to engage the running surfaces 5, 6, as shown in FIG. 2 and 5. The raised part 3*a* of the flange 3 forms a guide surface for the roller 7.

In the embodiment, the drawer track 2 has a flange 13 whose running surface rests on the roller 11, and a flange 14 which is bent over the other side and on which the body of a drawer or a compartment base rests and which also performs the link with this part.

Figure 4:
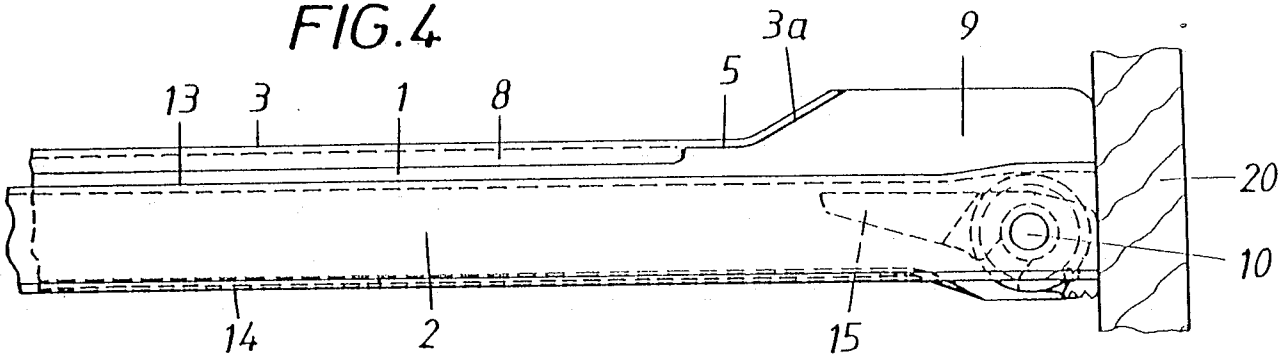
FIG. 4 shows a side view of an inserted drawer, the front panel of the drawer also being shown.

A free space is left between the roller 11 and the plate 9. The securing means against withdrawal is a swivel catch 15 which may be made of metal or in the form of a plastic part and has a bearing hole for the axle 10 on which the said catch can be locked under spring force through the spreading of the side walls of an insertion slot 16. That end 17 of the catch 15 which points toward the running surfaces 5, 6 and into the carcass track forms a wedge which, in the rest position according to FIG. 2, permits insertion of the roller 7. The other end of the catch 15 is provided with a handle 18 and, in the rest position according to FIG. 2, forms a stop projecting beyond the end face 19 of the plate 9. If the drawer is moved into the closed position, as shown in FIG. 4, its front panel 20 engages the stop 18 and thus swivels this stop into a position flush with the front edge 19 of the plate 9, with the result that the catch 15 is swivelled upward into the position shown in FIGS. 1, 4 and 5. In this position, a nub-like locking projection on the outside of the stop 18 engages a locking indentation 21 of the plate 9, so that the catch 15 is secured in the blocking position. Instead of a nub and locking indentation, the catch 15 is secured in the blocking position by a spring 22, that engages recesses in the track 1. In its blocking position, the catch 15 prevents the roller 7 from becoming disengaged from the two guide surfaces 5, 6, so that the drawer is secured against removal. The catch 15 can be swivelled into the rest position according to FIG. 2 by actuating the handle 18, after which the roller 7 can be pulled out. If the catch 15 is in the blocking position prior to insertion of the drawer, as in FIG. 1, it is swivelled during the insertion process by the roller 7, under the weight of the drawer, into the rest position according to FIG. 2.

Instead of a swivel catch 15, it would also be possible to use a sliding catch which is displaceable by means of outer handles, is preferably likewise mounted on the axle 10 and can be fixed in the blocking position.

I claim:

1. A slide for drawers, component bases and other components that are slidable with respect to a frame, having guides on said frame and guides on said slidable component, said slidable component guides having rollers mounted thereon and being formed by tracks with running surfaces for rollers mounted on said frame guides, said frame guides having upper and lower running surfaces and rollers mounted on axles in front end regions of said frame guides, said upper and lower running surfaces being spaced apart in said front end regions to provide insertion apertures for insertion of said slidable component guides, said frame guides having swivel catch means in the region of at least one of said insertion apertures, said swivel catch means being arranged to secure said slidable component against withdrawal from said frame by swivel operation from a non-blocking rest position into a blocking position relative to a slidable component roller, said swivel catch means, in said blocking position, projecting into a path of withdrawal of a slidable component roller to block said roller from withdrawal from said insertion aperture, wherein at least one said swivel catch means is mounted on at least one of said axles of said frame guide rollers.

2. A slide as claimed in claim 1, wherein said swivel catch means can be fixed in said blocking position by spring-loaded locking projections which engage recesses in said frame guide.

3. A slide as claimed in claim 1, wherein said swivel catch means carry actuating extensions which point toward a front end of said frame guide and, in said rest position, form stops which project beyond said frame guides, for a front panel and the like, of said slidable component so that said swivel catch means can be displaced into said blocking position as a result of insertion of said slidable component into said frame.

4. A slide as claimed in claim 2, wherein said swivel catch means carry actuating extensions which point toward a front end of said frame guide and, in said rest position, form stops which project beyond said frame guides, for a front panel and the like, of said slidable component so that said swivel catch means can be displaced into said blocking position as a result of insertion of said slidable component into said frame.

5. A slide as claimed in claim 1, wherein said swivel catch means is kept depressed in said blocking position by spring force means.

6. A slide according to claim 4, wherein said swivel catch means forms a wedge that in said non-blocking rest position permits insertion of said slidable component roller into said frame guide.

7. A slide for drawers, component bases and other components that are slidable with respect to a frame, having guides on said frame and guides on said slidable component, said slidable component guides having rollers mounted thereon and being formed by tracks with running surfaces for rollers mounted on said frame guides, said frame guides having upper and lower running surfaces and rollers mounted on axles in front end regions of said frame guides, said upper and lower running surfaces being spaced apart in said front end regions to provide insertion apertures for insertion of said slidable component guide rollers, said frame guides having swivel catch means in the region of at least one of said insertion apertures, said swivel catch means being arranged to secure said slidable component against withdrawal from said frame by swivel operation from a non-blocking rest position into a blocking position relative to a slidable component roller, said swivel catch means, in said blocking position, projecting into a path of withdrawal of a slidable component roller to block said roller from withdrawal from said insertion aperture, at least one of said swivel catch means being mounted on at least one of said axles of said frame guide rollers, wherein said swivel catch means is mounted on said mounted axle by spreading about said mounted axle spring-loaded side walls of an insertion slot in said swivel catch means.

8. A slide as claimed in claim 1, wherein said swivel catch means embraces said frame guide roller on the axle of which said swivel catch means is mounted.

9. A slide according to claim 7, wherein said swivel catch means forms a wedge that in said non-blocking rest positions permits insertion of said slidable component roller into said frame guide.

* * * * *